US006918183B2

(12) United States Patent
Alfi

(10) Patent No.: US 6,918,183 B2
(45) Date of Patent: Jul. 19, 2005

(54) KNIFE WITH SLIDABLE BLADE PROTECTOR

(75) Inventor: Elias Alfi, Tarzana, CA (US)

(73) Assignee: Alfi International, Inc., Newbury Park, CA (US)

( * ) Notice: Subject to any disclaimer, the term of this patent is extended or adjusted under 35 U.S.C. 154(b) by 0 days.

(21) Appl. No.: 10/672,156

(22) Filed: Sep. 26, 2003

(65) Prior Publication Data

US 2004/0128842 A1 Jul. 8, 2004

Related U.S. Application Data

(60) Provisional application No. 60/423,742, filed on Nov. 5, 2002.

(51) Int. Cl.[7] ..... B25B 29/02

(52) U.S. Cl. ..... 30/151; 30/286

(58) Field of Search ..... 30/2, 151, 293, 30/153, 286

(56) References Cited

U.S. PATENT DOCUMENTS 5,662,669 A * 9/1997 Abidin et al. ..... 606/167

* cited by examiner

*Primary Examiner*—Douglas D Watts
(74) *Attorney, Agent, or Firm*—Christie, Parker & Hale, LLP

(57) ABSTRACT

A knife is provided with a sliding blade cover that protects the knife blade when not in use. The knife comprises a knife body having a top edge, a bottom edge, a proximal edge, a distal edge and a midsection between the top, bottom, proximal and distal edges. A slot extends at least a part of the way through the midsection along the length of the knife body. A knife blade extends from the bottom edge of the knife body. A blade cover is slidably mounted in the slot. The blade cover has at least one top portion that extends into the slot and two downwardly extending side portions attached to the at least one top portion. The blade cover is moveable within the slot between a first position where the two downwardly extending side portions cover the left and right sides of the blade and a second position where the two downwardly extending side portions do not cover the sides of the blade.

18 Claims, 8 Drawing Sheets

KNIFE WITH SLIDABLE BLADE PROTECTOR

CROSS-REFERENCE TO RELATED APPLICATION

This application claims the benefit of U.S. Provisional Patent Application No. 60/423,742, filed Nov. 5, 2002, the entire disclosure of which is incorporated herein by reference.

BACKGROUND

Knives with mechanisms for protecting the knife blade when not in use are known. Some of these knives are of a folding variety, with a blade that pivots from an open position to a folded position where the blade is protected within an opening in the knife handle, such as a common folding pocketknife. Another type of protecting mechanism allows for retraction of the knife blade. In this variety the knife blade can be moved from an open position which has the blade extended from the knife handle, to a closed position which has the blade disposed within an opening within the knife handle, and where the movement of the knife is substantially linear.

For some applications, the folding and retractable designs are acceptable. However, for other applications, these designs are less desirable. For example, for scoring dough, it is advantageous for the knife to have a smooth bottom surface to avoid tearing of the dough. A scoring knife with such a design is described in U.S. Pat. No. 6,487,948, the disclosure of which is incorporated herein by reference. If the knife blade of the scoring knife can be folded or retracted, the bottom surface of the knife will not be smooth, thus making the knife less desirable for scoring.

Accordingly, a need exists for a knife having a non-folding and non-retractable blade but that includes a mechanism for protecting the knife blade when not in use.

SUMMARY OF THE INVENTION

The present invention is directed to a knife having a sliding blade cover to protect the knife blade when not in use. In one embodiment, the knife comprises a knife body having a top edge, a bottom edge, a proximal edge, a distal edge and a midsection between the top, bottom, proximal and distal edges. A slot extends at least a part of the way through the midsection along the length of the knife body. A knife blade extends from the bottom edge of the knife body. A blade cover is slidably mounted in the slot. The blade cover has at least one top portion that extends into the slot and two downwardly extending side portions attached to the at least one top portion. The blade cover is moveable within the slot between a first position where the two downwardly extending side portions cover the left and right sides of the blade and a second position where the two downwardly extending side portions do not cover the sides of the blade.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF THE INVENTION

Figure 1:
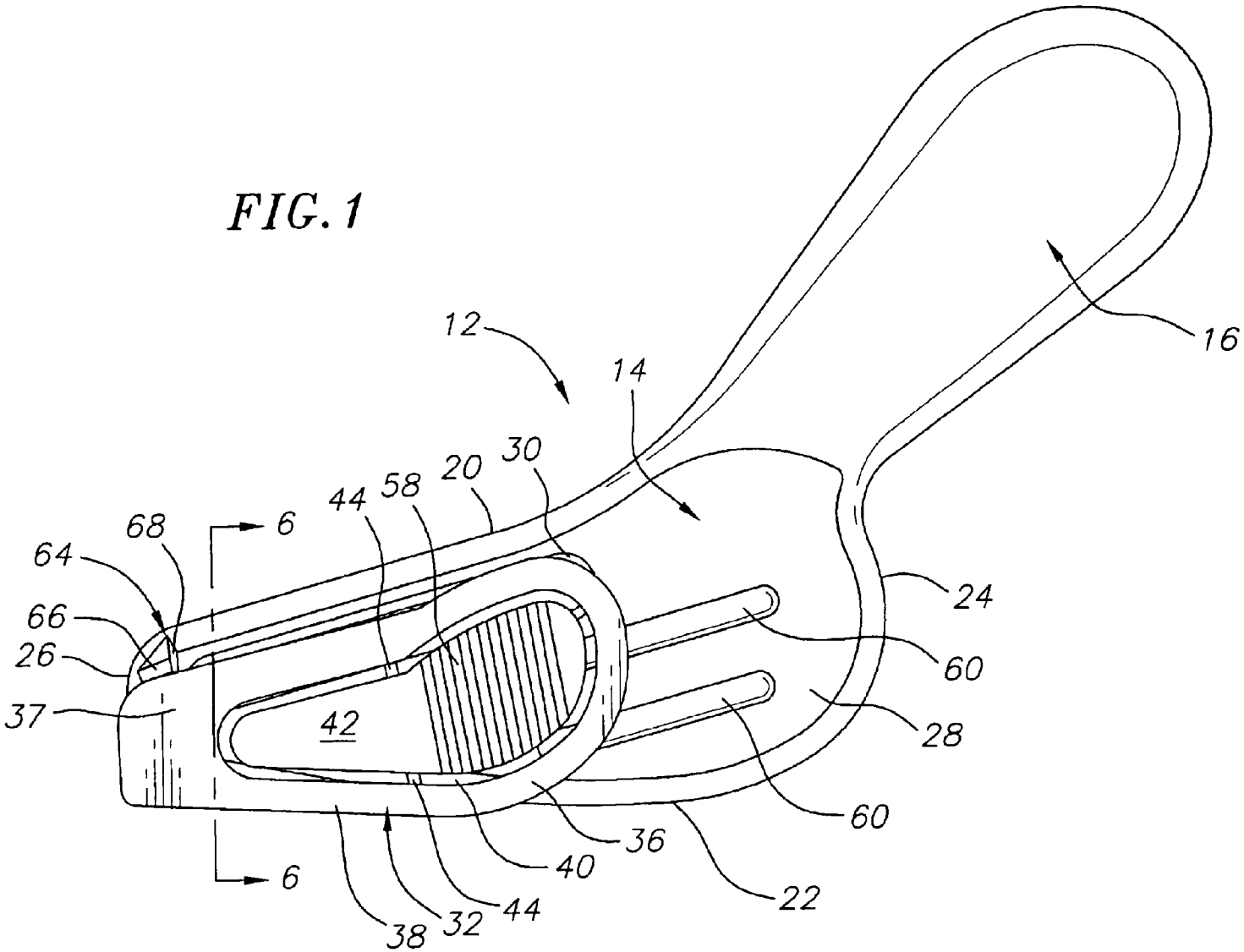
FIG. 1 is a side view of a knife according to the invention where the knife blade is covered by a blade cover.
Figure 2:
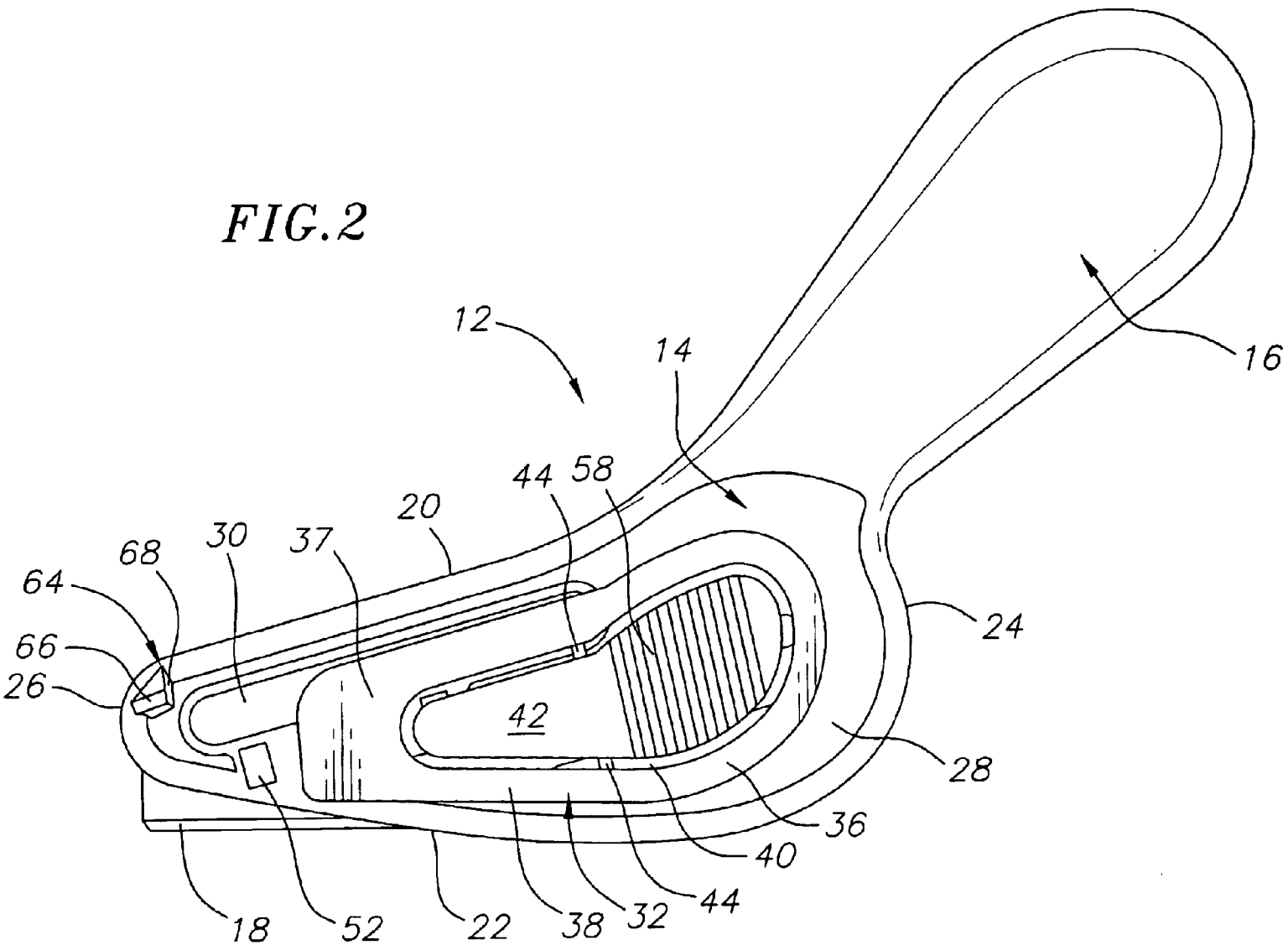
FIG. 2 is a side view of the knife of FIG. 1 wherein the blade cover is moved away from the blade to expose the blade.
Figure 3:
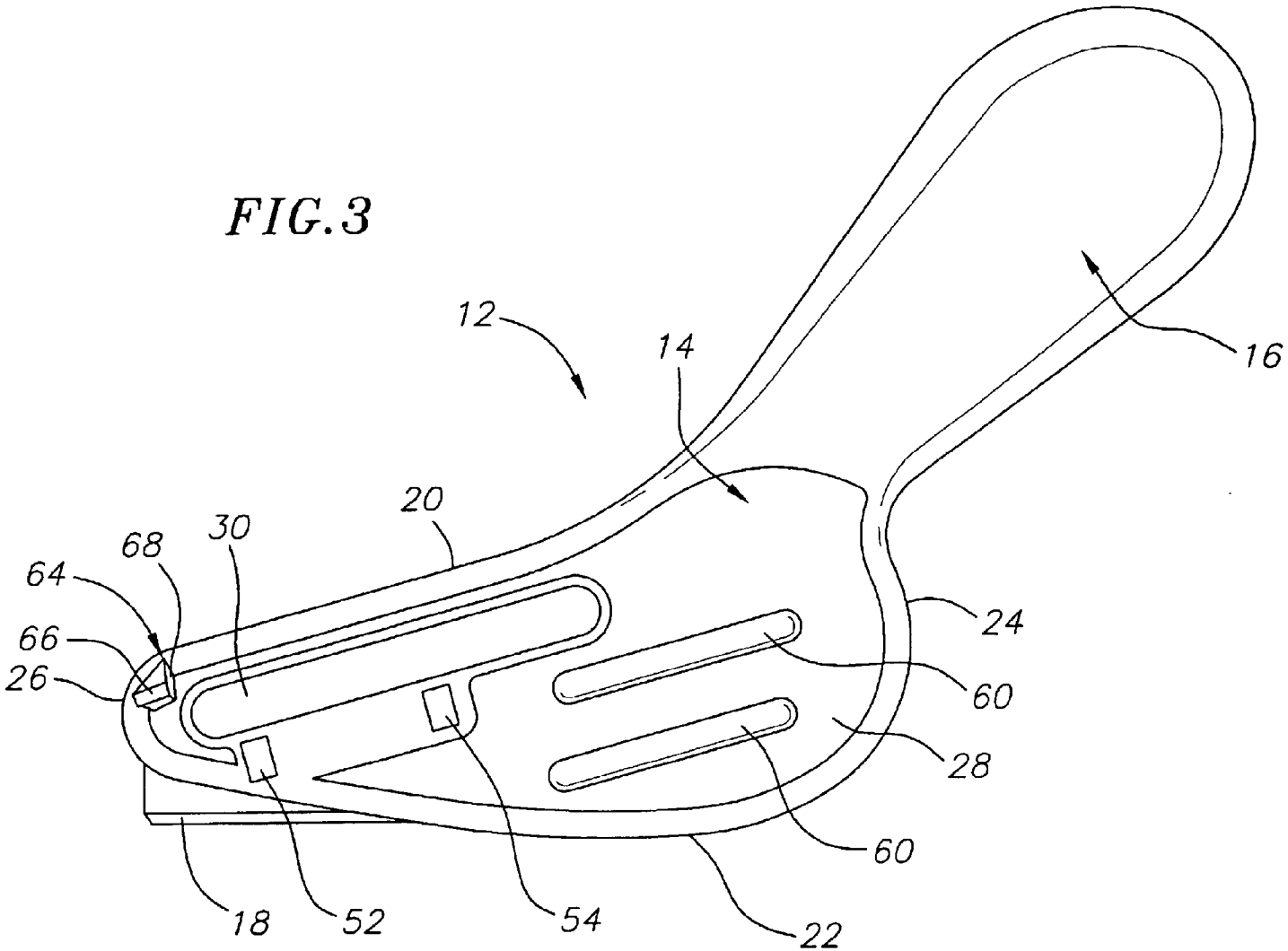
FIG. 3 is a side view of the knife of FIG. 1 without the blade cover.
Figure 6:
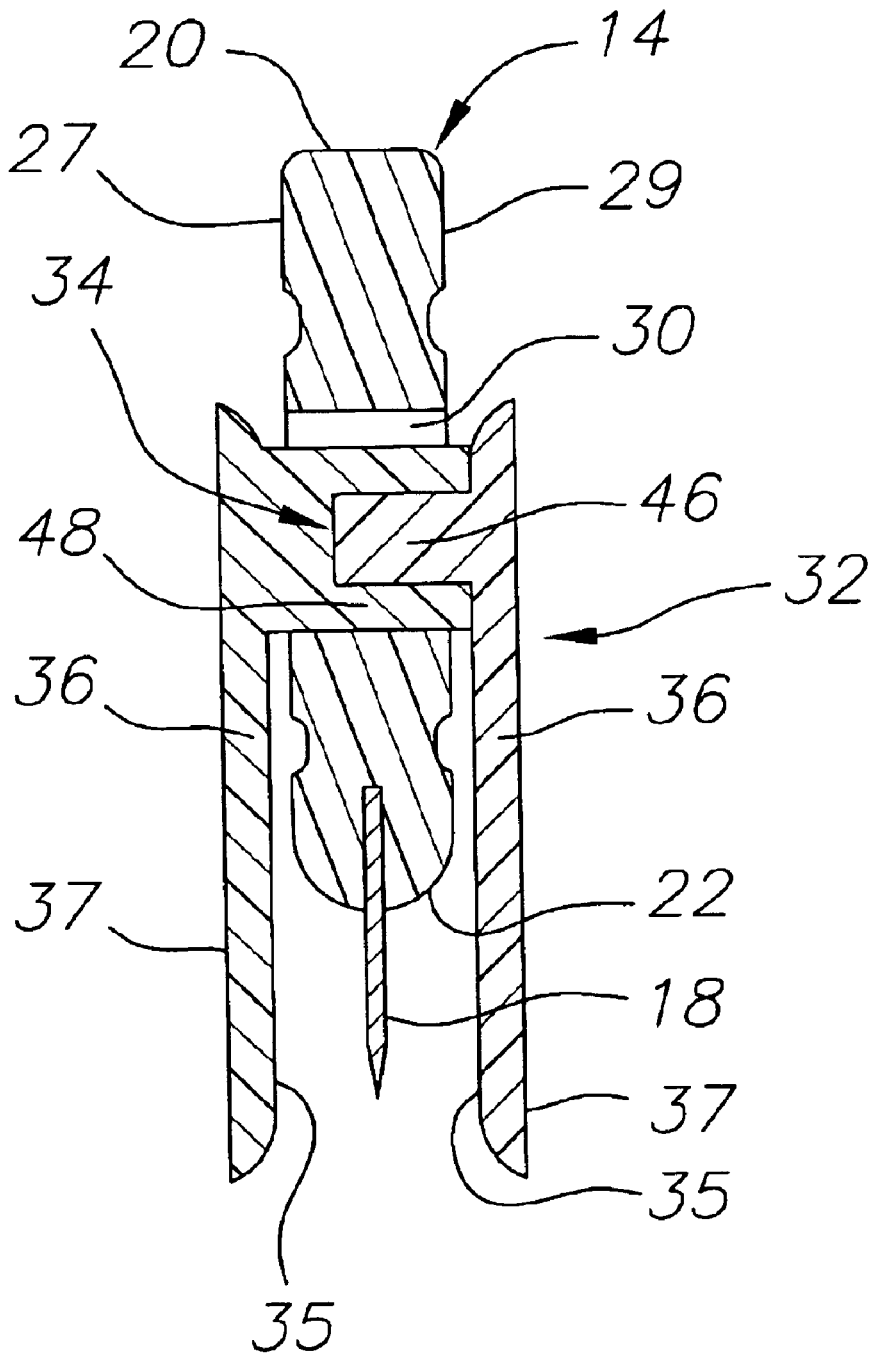
FIG. 6 is an end cross-sectional view of the knife of FIG. 1 along line 6—6.

The present invention is directed to a knife having a slidable blade protector. As shown in FIGS. 1 to 3, the knife 12 includes an elongated body 14 at its distal end having a blade 18 extending downwardly therefrom and a handle 16 at its proximal end for the user to grip the knife. The elongated body 14 includes a top edge 20, a bottom edge 22, a proximal edge 24, a distal edge 26 and a midsection 28 between the top, bottom, proximal and distal edges. In the depicted embodiment, the distal edge 26 is curved and extends beyond the distal end of the blade 18, as best shown in FIGS. 2 and 3. The body 14 also includes a right side 27 and a left side 29, as best shown in FIG. 6, that define the width of the body. The knife 12 can be made of any suitable material, and is preferably made of plastic.

The precise shape of the knife is not critical to the invention. In the embodiment shown in FIGS. 1 to 3, the knife body 14 is generally triangular with rounded edges, and the handle 16, which extends generally diagonally from the distal end of the top edge 20 of the body, is generally rectangular with a rounded proximal end. This shape is desirable because, in use, the body 14 is closer to the object being cut, and the handle 16 is spaced sufficiently above the object being cut so that the user can grip the handle and have one or more fingers wrapped around or tucked under the handle, thereby permitting the user to apply necessary pressure on the knife. Other knife shapes are considered within the scope of the invention.

The size of the knife 12 is not critical and can vary depending on the application. The elongated body 14 has a length preferably ranging from about 6 cm to about 15 cm, more preferably from about 8 cm to about 12 cm. The handle 16 has a length preferably ranging from about 4 cm to about 10 cm, more preferably from about 5 cm to about 7 cm. The width of the midsection 28 of the body 12 preferably ranges from about 1 mm to about 5 mm, more preferably from about 2 mm to about 3 mm. Preferably one or more, and more preferably all, of the top edge 20, bottom edge 22, proximal edge 24, and distal edge 26 has a width slightly greater than the width of the midsection, for example, 1 to 5 mm greater than the width of the midsection.

The knife blade 18 has a maximum exposed height (i.e., a height that extends outside of the knife body 14) preferably ranging from about 3 mm to about 20 mm, more preferably from about 5 mm to about 10 mm. More preferably, the bottom edge 22 of the knife body 14 curves upward at its distal end so that the height of the exposed portion of the knife blade 18 is greatest at its distal end and decreases toward the proximal end of the exposed portion, as best shown in FIGS. 2 and 3. With this design, the extent to which the user tilts the knife during cutting will affect the depth that the blade 18 enters the surface being cut.

The blade can be made of any suitable material, such as stainless steel, and is preferably provided with a Teflon coating. The knife blade 18 is preferably fixedly attached to the knife body so that it is not moveable relative to the body.

The knife 12 includes an elongated slot 30 extending through the midsection 28 along a portion of the length of the body 14 so that the slot does not contact either the proximal edge 24 or the distal edge 26, as best shown in FIG. 3. In the depicted embodiment, the slot 30 extends all the way through the width of the knife, as best shown in FIG. 6.

A blade cover 32 is slidably mounted in the slot 30. The blade cover 32 can be made of any suitable material, such as plastic or metal. In the embodiment of FIGS. 1 to 3, the blade cover 32 includes a top portion 34 that extends through the slot 30 and two downwardly extending side portions 36 that extend from the slot and along the right and left sides 27 and 29 of the knife body, as best shown in FIG. 6, so that inner surfaces 35 of the side portions face the left and right sides of the knife body and outer surfaces 37 of the side portions face away from the knife body.

More particularly, each side portion 36 comprises an outer body 38 defining an inner opening 40 in which an inner body 42 is hingedly mounted to the outer body by two joints 44. The size and shape of the outer body 38 is not critical, but it is preferably sized and shaped to generally fit within the midsection 28 of the knife body Similarly, the size and shape of the inner body 42 is not critical, but it is preferably sized and shaped to fit within the inner opening 40 of the outer body 38.

Figure 4:
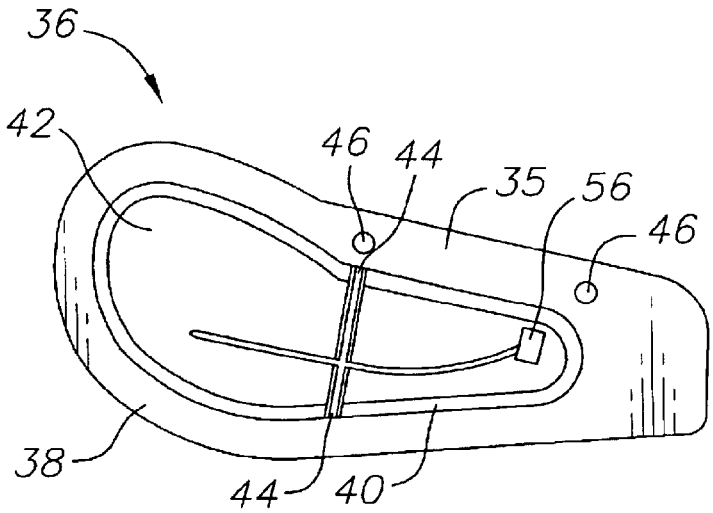
FIG. 4 is a side view of the inside surface of one of the side portions of the blade cover of the knife of FIG. 1.

In the depicted embodiment, the outer body 38 of one side portion 36 includes two small protrusions 46 on the top of its inner surface 35, as best shown in FIGS. 4 and 6. The outer body 38 of the other side portion 36 includes on the top of its inner surface 35 two corresponding protrusions 48, each including a bore 50 adapted to receive one of the protrusions 46 of the other side portion. The protrusions 46 and 48 extend through the slot 30 in the knife body 14 and snap together to join the side portions 36 to each other on opposite sides of the knife body. Thus, in this embodiment, the protrusions 46 and 48, which function as male-female connectors, form the top portion 34 of the blade cover 32.

The protrusions 46 and 48 are sized to slide within the slot 30 so that the blade cover 32 can be moved relative to the knife body 14. In its default position, the blade cover 32 covers the knife blade 18, as best shown in FIG. 1. To use the knife to cut an object, the user slides the blade cover 32 proximally to thereby expose the blade 18.

Figure 5:
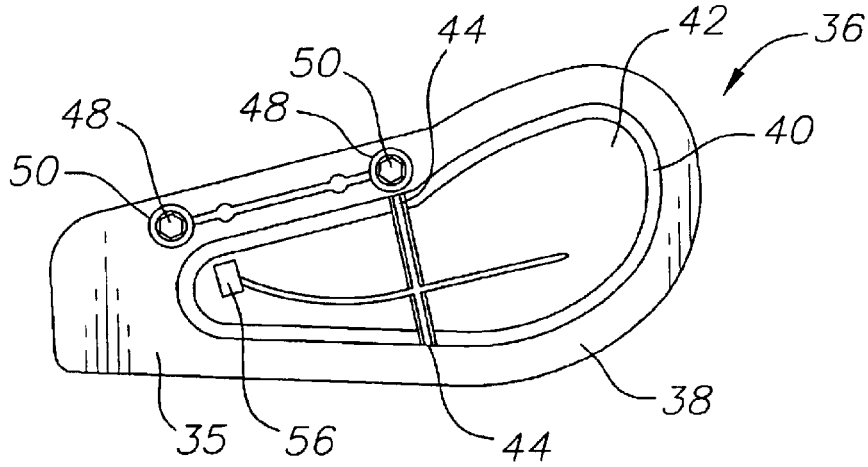
FIG. 5 is a side view of the inside surface of the other side portion of the blade cover of the knife of FIG. 1.

Preferably a mechanism is provided for "locking" or maintaining the blade cover 32 in the default position where it is covering the knife blade 18. In the depicted embodiment, the right and left sides 27 and 29 of the knife each include a distal notch 52 and a proximal notch 54, as shown in FIG. 3 for the right side of the knife. The notches 52 and 54 are located at the same positions on the right and left sides 27 and 29 of the knife. The inner surfaces 35 of the inner bodies 42 of the side portions 36 of the blade cover 32 each include a corresponding protrusion 56, as shown in FIGS. 4 and 5, that mates with the distal and proximal notches 52 and 54. When the blade cover 32 is in the default position, the protrusions 56 rest in the distal notches 52 on the sides of the knife body 14, thereby maintaining the blade cover in place over the blade 18.

To move the blade cover 32 proximally to expose the blade 18, one exerts pressure on the proximal ends of the inner bodies 42 of the side portions 36, which, as noted above, are hingedly attached to the outer bodies 38 of the side portions. This pressure moves the proximal ends of the inner bodies 42 toward the knife body 14 and the distal ends of the inner bodies away from the knife body so that the protrusions 56 are freed from the distal notches 52 and the blade cover 32 can be slid proximally. When the blade cover 32 has been moved proximally a sufficient distance to expose the entire blade 18, the protrusions 56 rest in the proximal notches 54 to "lock" or hold the blade cover in a position away from the blade. When the user wishes to cover the blade 18, pressure is again exerted on the proximal end of the inner body 42, thereby freeing the protrusions 56 from the proximal notches 54. In the depicted embodiment, the proximal ends of the inner bodies 42 of the side portions 36 of the blade cover 32 include a plurality of small ridges 58 to enhance the friction between the inner bodies and the user's fingers.

The blade cover 32 has a length at least equal to that of the blade 18, and preferably slightly greater than that of the blade 18. The knife blade 18 has an exposed length preferably ranging from about 1 cm to about 6 cm, more preferably from about 2 cm to about 4 cm, and the blade cover 32 has a length ranging from about 3 cm to about 8 cm, which can vary depending on the dimensions of the knife. Similarly, the two downwardly extending side portions 36 of the blade cover 32 have a height sufficient for the bottoms of the side portions to extend beyond the bottom of the knife blade 18, as best shown in FIG. 6.

The size and shape of the slot 30 can vary so long as the slot extends into the knife body 14 a sufficient distance so that the blade cover 32 can be positioned in the slot and the two downwardly extending side portions 36 of the blade cover can completely cover the knife blade 18. The slot 30 is preferably of sufficient length so that the blade cover 32 can be slid proximally away from the blade 18 so that the blade cover does not overlap or cover any part of the blade, and more preferably not overlap or cover any part of the bottom edge 22 of the knife body 14.

The depicted knife also includes two elongated, preferably generally parallel, ridges 60 extending along each side of the midsection 28 of the knife body 14, as best shown in FIG. 3. The ridges 60 assist in guiding the blade cover 32 when it is moved relative to the knife body 14.

Figure 9:
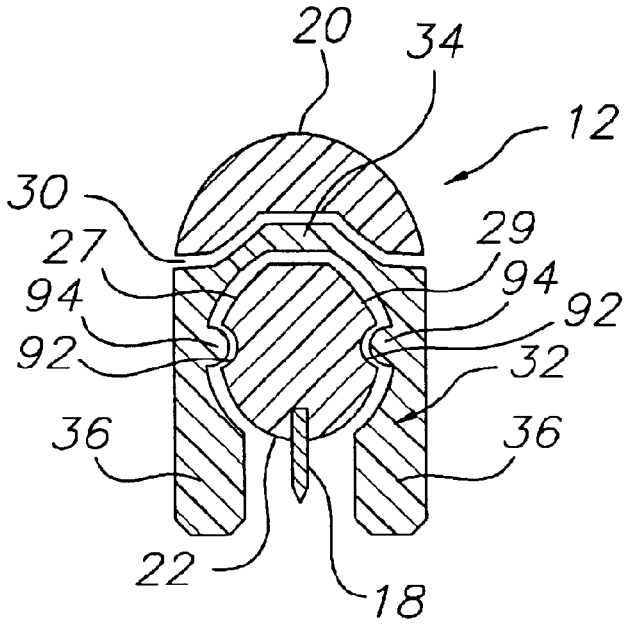
FIG. 9 is an end cross-sectional view of the knife of FIG. 7.

The knife of the invention is particularly suitable for scoring bread dough. In use, the baker slides the knife along the top of the dough with at least a portion of the bottom edge 22 of the knife body 14 in contact with the dough. The bottom edge 22 of the knife body 14 is curved or rounded, i.e. convex, so that it is generally U-shaped, as best shown in FIGS. 6 and 9. The curved bottom edge 22 does not penetrate the dough, while the blade 18 creates a slash of appropriate depth. The bottom edge 22 of the knife is preferably also smooth to prevent the bottom edge from catching on and damaging the dough. As the knife reaches the end of the dough and the blade is pulled from the dough, the curved distal edge 26, which extends beyond the distal end of the blade 18, also does not penetrate the dough, but allows the knife to smoothly ease away from the dough. By this design, it is unnecessary for the user to determine how deep to insert the blade or how much pressure to place on the knife because only the blade (and not the body) enters the dough as the bottom edge of the knife is run over the dough. Notably, the user can view the scoring process from directly above the knife even though the blade is not in view because it is unnecessary for the user to see the placement of the blade to achieve the desired result.

The inventive knife is also useful for cutting corrugated boxes. In particular, the knife includes a small angled protrusion 64 extending outwardly from the distal end of the left side 29 of the midsection 28 of the knife body 14, as best shown in FIGS. 1 to 3. The angled protrusion 64 includes an outer surface 66 that angles away from the body in a proximal direction. The angled protrusion 64 also includes a generally flat proximal surface 68. In use, the blade cover 32 is slid proximally to expose the blade 18, and the blade is used to cut, for example, three sides of a square in a panel of a corrugated box. The user can then push the cut panel forward (i.e., into the box) using the distal end of the knife, and then contact the flat proximal surface 66 of the angled protrusion 64 with the inside surface of the cut panel to thereby pull the cut panel outside the box. The angled outer surface 66 of the angled protrusion prevents the protrusion from catching on the cut panel as the knife is pushed distally into the panel and box.

Figure 7:
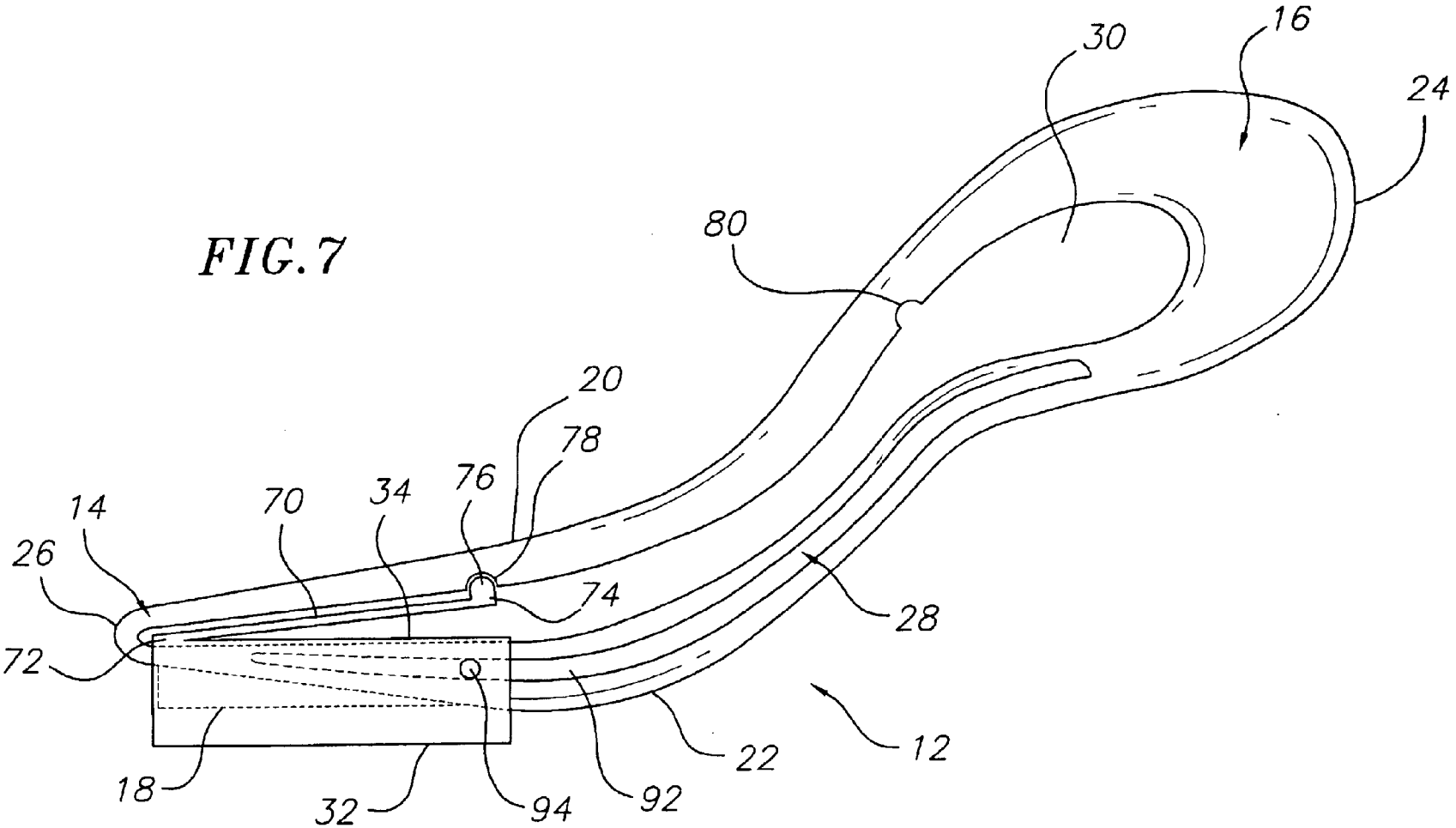
FIG. 7 is a side view of an alternative knife according to the invention where the knife blade is covered by a blade cover.
Figure 8:
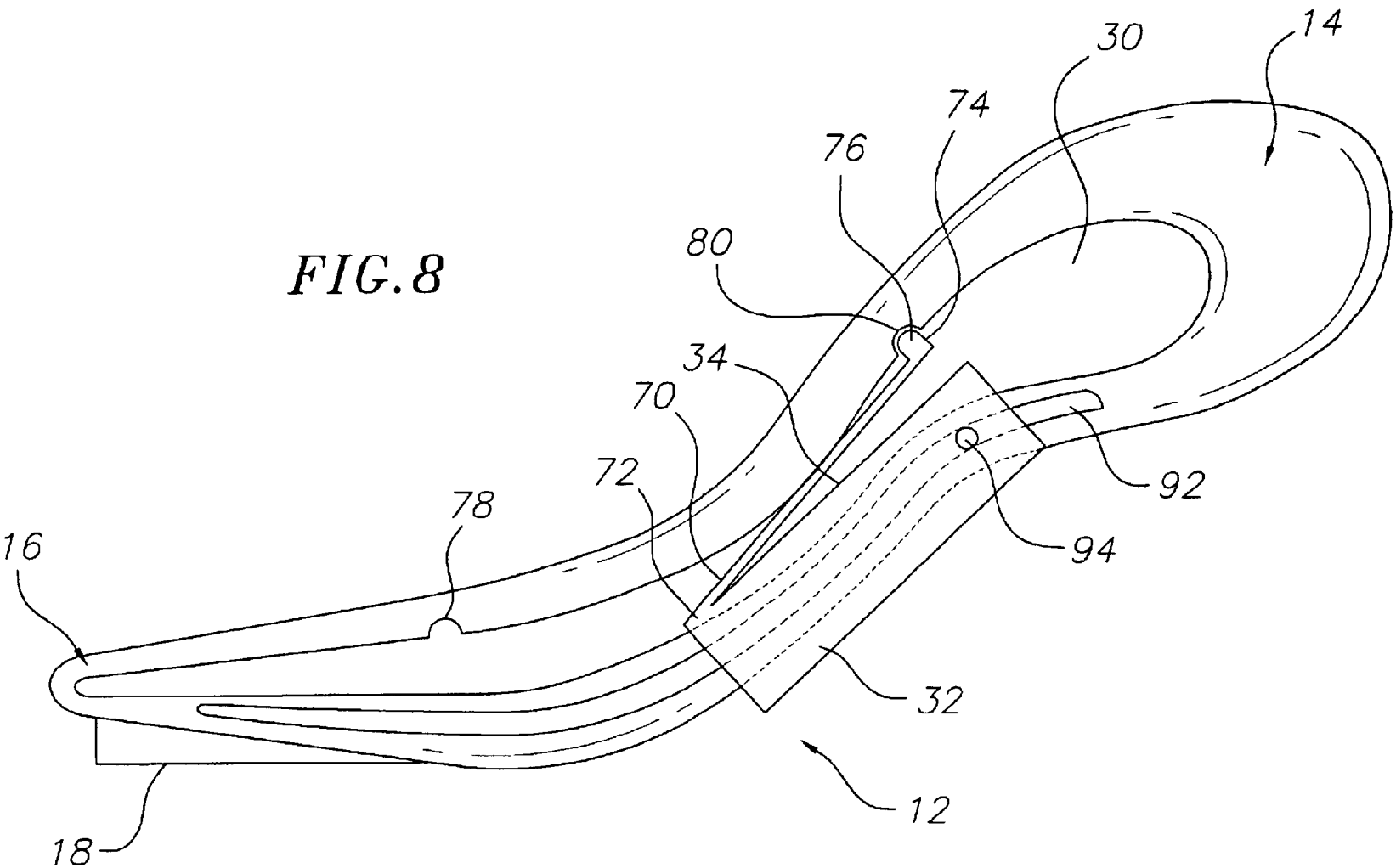
FIG. 8 is a side view of the knife of FIG. 7 wherein the blade cover is moved away from the blade to expose the blade.

An alternative embodiment of a knife according to the invention is shown in FIGS. 7 to 9, where like reference numerals indicate like parts unless otherwise indicated. The knife has an elongated body 14 having a distal end region 14 having a blade 18 extending downward therefrom and a proximal end region 14 that essentially forms a handle for the user to grip the knife. The knife is generally S-shaped. The knife includes an elongated slot 30 extending through the midsection 28 along a portion of the length of the knife so that the slot does not contact either the proximal edge 24 or the distal edge 26. A blade cover 32, which is slidably mounted in the slot 30, is generally in the shape of an upside-down "U" having a top portion 34 that extends through the slot 30 and two downwardly extending side portions 36 that extend from the slot, similar to the embodiment described above.

The blade cover 32 includes an arm 70 having an attachment end 72 flexibly attached to the top portion 34 and a free end 74 that carries an upwardly-extending tab 76, which can be round (as depicted), square, rectangular or any other suitable shape. In the depicted embodiment, the attachment end 72 of the arm 70 is attached at an end of the blade cover 32, although it can be attached anywhere along the length of the cover. The knife body 12 includes a distal notch 78 positioned at the top of the slot 30 shaped to receive the tab 76 when the blade cover 32 is positioned over the knife blade 18. The knife body 12 also includes a proximal notch 80 positioned at the top of the slot 30 shaped to receive the tab 76 when the blade cover 32 is positioned proximal to the knife blade 18. In use, when the blade cover 32 is positioned over the knife blade 18 and the tab 76 is received in the distal notch 78, the user pushes down on the tab, thereby releasing the tab from the distal notch, and pushes the blade cover proximally away from the knife blade. The arm 70, being flexibly attached to the top portion 34 of the blade cover 32, tends to exert a force against the surface of the knife body that defines the top of the slot 30. As a result, when the blade cover 32 is properly positioned away from the blade 18, the tab 76 is received by the proximal notch 80 and locked or held in place away from the blade.

Other locking mechanisms are contemplated within the invention. For example, one or more tabs (not shown) can extend downward from the top portion 34 of the blade cover 32 and match with one or more notches (not shown) along the bottom edge of the slot 30.

The knife body 12 also includes two guide slots 92, each on a side of the knife, that run generally parallel to at least a portion of the primary slot 30. As shown best in FIG. 9, the downwardly extending side portions 36 of the blade cover 32 each include an inwardly extending tab 94. The inwardly extending tabs 94 align with and fit inside the guide slots 92 to help guide the blade cover 32 as it is slid along the length of the knife body 12. The tabs 94 can have any suitable shape. The guide slots can be eliminated or modified as desired in accordance with the invention.

Figure 10:
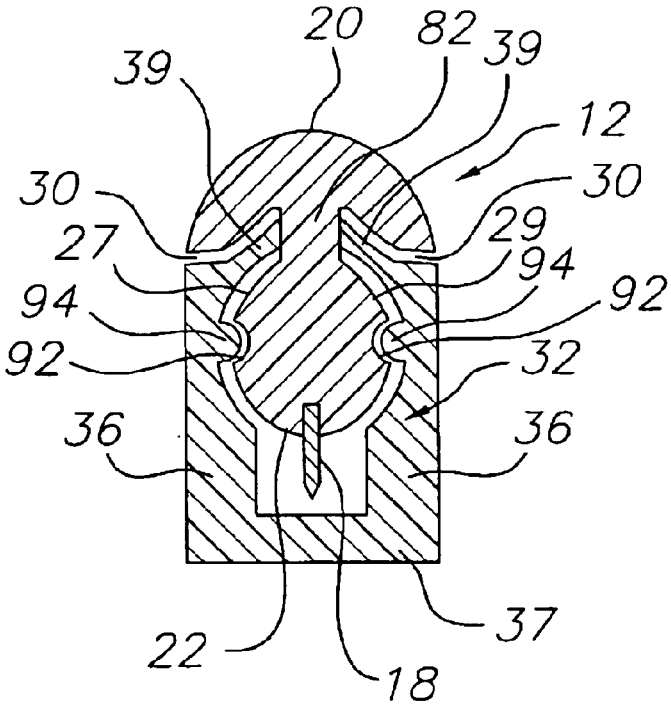
FIG. 10 is an end cross-sectional view of an alternative knife according to the invention.

In yet an alternative embodiment, the knife body has two slots 30 extending along its length, one on the right side 27 of the knife body and one on the left side 29, as shown in FIG. 10. In this embodiment, neither slot 30 extends all the way through the knife body 12. Instead the slots 30 are separated from each other by a thin wall 82 having a thickness less than the thickness of the knife body 12. Preferably the slots 30 on either side of the knife body have the same size and shape so that the slots are essentially mirror images of each other.

In this embodiment, the knife cover 32 is generally U-shaped, having two downwardly extending downwardly extending side portions 36, a bottom portion 37 joining the side portions, and two top portions 34, each top portion extending into a different slot 30. As in the previous embodiments, the blade cover 32 has a length at least equal to that of the blade 18, and the two downwardly extending side portions 36 have a height sufficient for the bottoms of the side portions to extend beyond the bottom of the knife blade 18. Thus, the bottom portion 37 is positioned below the bottom of the knife blade 18 when the cover is positioned over the knife blade. The top of the blade cover 32 comprises two inwardly extending top portions 39, each of which extends into one of the two slots 30.

In this embodiment, the blade cover 32 preferably includes two arms 70, each being flexibly attached to the top of a different inwardly extending top portion 39 and carrying an upwardly extending tab 76. The knife body 12 includes two distal notches 78 positioned at the tops of the two slots 30 shaped to receive the tabs 76 when the blade cover 32 is positioned over the knife blade 18. The knife body 12 also includes two proximal notches 80 positioned at the tops of the slots 30 shaped to receive the tabs 76 when the blade cover 32 is positioned proximal to the knife blade 18. This embodiment functions in a manner very similar to the previously-described embodiment, but the user needs to push down on two tabs 76 to release the blade cover 32 from a locked position.

The preceding description has been presented with references to presently preferred embodiments of the invention. Persons skilled in the art and technology to which this invention pertains will appreciate that alterations and changes in the described structures can be practiced without meaningfully departing from the principle, spirit and scope of this invention. Accordingly, the foregoing description should not be read as pertaining only to the precise structures described and shown in the accompanying drawings, but rather should be read as consistent with and as support for the following claims, which are to have their fullest and fairest scope.

What is claimed is:

1. A knife comprising:

a knife body having a top edge, a bottom edge, a proximal edge, a distal edge and a midsection between the top, bottom, proximal and distal edges, wherein the knife body has a slot extending at least a part of the way through the midsection along the length of the knife body, the slot extending all the way through the width of the knife body:

a fixed knife blade extending from the bottom edge of the knife body and having left and rights sides; and a blade cover slidably mounted in the slot, the blade cover having at least one connecting portion that extends all the way through the slot and two downwardly extending side portions attached to the at least one connecting portion, wherein the blade cover is slidable within the slot between a first position where the two downwardly extending side portions cover the left and right sides of the blade and a second position where the two downwardly extending side portions do not cover the sides of the blade.

2. The knife according to claim 1, further comprising a handle extending from the knife body.

3. The knife according to claim 1, wherein the slot extends completely through the width of the knife body.

4. The knife according to claim 1, wherein at least one of the side portions comprises an outer body defining an inner opening in which an inner body is hingedly mounted to the outer body.

5. The knife according to claim 4, wherein the inner body includes on an inner surface thereof a protrusion that is mateable with distal and proximal notches on a corresponding side surface of the knife body, such that, in use, when the blade cover is positioned over the blade, the protrusion mates with the distal notch, and when the protrusion mates with the proximal notch, the blade cover is not positioned over the blade.

6. The knife according to claim 1, wherein each side portion comprises an outer body defining an inner opening in which an inner body is hingedly mounted to the outer body.

7. The knife according to claim 6, wherein each inner body includes on an inner surface thereof a protrusion that is mateable with distal and proximal notches on a corresponding side surface of the knife body, such that, in use, when the blade cover is positioned over the blade, the protrusions on the inner bodies mate with the distal notches, and when the protrusions mate with the proximal notches, the blade cover is not positioned over the blade.

8. The knife according to claim 1, wherein at least one side portion of the blade cover includes on an inner surface thereof a protrusion that is mateable with distal and proximal notches on a corresponding side surface of the knife body, such that, in use, when the blade cover is positioned over the blade, the protrusion mates with the distal notch, and when the protrusion mates with the proximal notch, the blade cover is not positioned over the blade.

9. The knife according to claim 1, wherein the side portions of the blade cover each include on an inner surface thereof a protrusion that is mateable with distal and proximal notches on a corresponding side surface of the knife body, such that, in use, when the blade cover is positioned over the blade, the protrusions mate with the distal notches, and when the protrusions mate with the proximal notches, the blade cover is not positioned over the blade.

10. The knife according to claim 1, wherein the connecting portion of the blade cover comprises one or more male-female connectors that join the side portions to each other.

11. The knife according to claim 1, wherein the blade cover has a length greater than the length of the blade.

12. The knife according to claim 1, wherein the side portions of the blade cover, when positioned over the blade, have bottom edges that extend beyond a bottom edge of the blade.

13. The knife according to claim 1, wherein the bottom edge of the body is curved along its entire width.

14. The knife according to claim 1, further comprising an angled protrusion extending outwardly from a side of the knife body, the angled protrusion including an outer surface that angles away from the body in a proximal direction and a generally flat proximal surface at the proximal end of the angled surface.

15. The knife according to claim 1, wherein the knife body has a width ranging from about 1 mm to about 5 mm.

16. The knife according to claim 15, wherein the knife body has a width ranging from about 2 mm to about 3 mm.

17. The knife according to claim 15, wherein the bottom edge of the knife body has a with greater than the width of the midsection of the knife body.

18. The knife according to claim 1, wherein the knife blade is not moveable relative to the knife body.

* * * * *